US006016776A

United States Patent [19]

Jonsson

[11] Patent Number: 6,016,776

[45] Date of Patent: Jan. 25, 2000

[54] CYLINDER

[75] Inventor: Bo Jonsson, Habo, Sweden

[73] Assignee: Aktiebolaget Electrolux, Stockholm, Sweden

[21] Appl. No.: 08/930,924

[22] PCT Filed: Apr. 3, 1996

[86] PCT No.: PCT/SE96/00437

§ 371 Date: Dec. 9, 1997

§ 102(e) Date: Dec. 9, 1997

[87] PCT Pub. No.: WO96/31691

PCT Pub. Date: Oct. 10, 1996

[30] Foreign Application Priority Data

Apr. 7, 1995 [SE] Sweden ..... 9501337

[51] Int. Cl.[7] ..... F02B 33/04

[52] U.S. Cl. ..... 123/65 A; 123/65 P; 123/73 PP; 123/182.1

[58] Field of Search ..... 123/65 A, 65 V, 123/65 P, 73 PP, 182.1

[56] References Cited

U.S. PATENT DOCUMENTS

| | | | |
|---|---|---|---|
| 2,742,380 | 4/1956 | Peters | 123/182.1 |
| 4,026,254 | 5/1977 | Ehrlich | 123/73 AA |
| 4,121,552 | 10/1978 | Mithuo et al. | 123/65 PE |
| 4,178,886 | 12/1979 | Uchinishi | 123/73 A |
| 4,353,333 | 10/1982 | Iio | 123/73 R |
| 4,730,540 | 3/1988 | Kinouchi . | |
| 5,025,760 | 6/1991 | Webb et al. | 123/73 PP |
| 5,048,290 | 9/1991 | Lavenius et al. . | |
| 5,211,140 | 5/1993 | Hironaka et al. | 123/65 P |
| 5,361,738 | 11/1994 | Iida | 123/182.1 |
| 5,870,981 | 2/1999 | Knaus et al. | 123/65 A |

FOREIGN PATENT DOCUMENTS

| | | |
|---|---|---|
| 37 02 193 A1 | 10/1987 | Germany . |
| 623 113 | 5/1981 | Switzerland . |

*Primary Examiner*—Noah P. Kamen
*Assistant Examiner*—Hai Huynh
*Attorney, Agent, or Firm*—Pearne, Gordon, McCoy & Granger LLP

[57] ABSTRACT

Cylinder (1) for a two-stroke combustion engine intended for a handheld working tool, preferrably a chain saw. The exhaust port's (3) mouth (17) inside the cylinder as well as the cylinder's transfer ports (5, 6, 7, 8) are arranged symmetrically around a common symmetry plane (9) which follows the cylinder's symmetry axis (10). At the exhaust port's (3) mouth (11) on the outside of the cylinder a fastening plane (12) with fastening holes (13) is embodied for a directly mounted muffler, and the fastening plane (12) is essentially perpendicular to the symmetry plane (9), and the exhaust port is angled sideways in relation to the symmetry plane (9) and its mouth (11) is shifted sideways in relation to the symmetry plane (9).

6 Claims, 3 Drawing Sheets

CYLINDER

TECHNICAL FIELD

The subject invention refers to a cylinder for a two-stroke combustion engine intended for a handheld working tool, preferably a chain saw.

BACKGROUND OF THE INVENTION

Engines for handheld working tools are often of the two-stroke type and very compactly designed, because the tool should naturally be as light and compact as possible. This aim permeates the design of all of the tool's components, including the cylinder's. Thus, cylinders for portable working tools, such as chain saws, have as a rule a very simple and compact design. This simplicity leads to a compact design and low production costs. At the same time it also leads to a fuel consumption and to exhaust emissions, which leaves a deal to be desired, especially as the requirements for low exhaust emissions gradually increase.

PURPOSE OF THE INVENTION

The purpose of the subject invention is to create a cylinder, which substantially reduces the above outlined problems, at the same time as it enables a compact design of the handheld working tool.

SUMMARY OF THE INVENTION

The above purpose is achieved in a cylinder in accordance with the invention having the characteristics appearing from the appended claims.

The cylinder in accordance with the invention is thus essentially characterized in that the mouth of the exhaust port inside the cylinder as well as the cylinder's transfer ports are symmetrically arranged around a common symmetry plane, which follows the cylinder's symmetry axis, and at the mouth of the exhaust port on the outside of the cylinder a fastening plane with fastening holes is embodied for a directly mounted muffler, and the fastening plane is essentially perpendicular to the symmetry plane, and that the exhaust port is angled sideways in relation to the symmetry plane and its mouth is shifted sideways in relation to the symmetry plane. Low scavenging losses are obtained by means of that the mouth of the exhaust port and the cylinder's transfer ports are arranged symmetrically around a common symmetry plane. Since the exhaust port is angled sideways in relation to the symmetry plane and its mouth being shifted sideways in relation to the symmetry plane, conditions for making room for an effective, directly mounted muffler are created, suitably supplied with a catalytic converter.

Furthermore, suitably the cylinder's inlet port as well as its exhaust port incline downwards in the flow direction in relation to a plane perpendicular to the axial direction of the cylinder bore. This contributes to effective gas flows in the engine and low losses. For the same reasons, suitably the cylinder is also supplied with four closed and ready cast transfer ports. By these measures and by an especially favorable positioning of a possible decompression valve, a cylinder is created with an unusually high efficiency for a handheld working tool. Some of these measures are known from other two-stroke engines, but they are not known for a cylinder for a handheld working tool, considering the special demands on such a tool.

Further characteristics and advantages of the invention will be apparent from the following description of various preferred embodiments. These will be more apparent with the support of the enclosed drawing figures.

BRIEF DESCRIPTION OF THE DRAWING

The invention will be described in closer detail in the following by way of various embodiments thereof with reference to the accompanying drawing figures, in which the same numbers in the different figures state one another's corresponding parts.

In FIG. 1, numeral reference 1 designates a cylinder in accordance with the invention. It has a cylinder bore 4. An inlet port 2 and an exhaust port 3 are connected with this bore. Seen in the flow direction of the inflowing and outflowing gases respectively, both of the ports incline downwards in relation to a plane perpendicular to the cylinder bore's 4 axial direction. This downwards angle is desirable with regards to the gases natural direction of flow. The inlet gas shall flow down15 wards since the current engine is crankcase scavenged. The exhaust gases shall be pressed out in a downwards direction from above. Thus, by means of the angling of the ports, more effective flow patterns in the engine are created, which contributes to a higher total efficiency. Furthermore, a better cooling of the exhaust port's 3 upper side 3' is achieved through this design. The inlet port's 2 as well as the exhaust port's 3 upper sides 2', 3' and undersides 2", 3" respectively incline downwards in the flow direction in relation to the mentioned plane. This gives a more consistent downward inclination for the gas flow compared to solutions where one of the two sides is not inclined downwards. The cylinder bore 4 has an axially extending symmetry axis 10.

The cylinder is supplied with four closed and ready cast transfer ports 5, 6, 7 and 8. These extend from the cylinder's lower part by the crank case and up into the cylinder wall and exit into the cylinder bore 4. The mouth of the transfer port 6 in the cylinder bore is indicated by 6' and the mouth of the transfer port 5 by 5'. This design of the transfer ports 5–8 bring about a more favorable transfer or scavenging than the designs with two transfer ports, which is usually used on chain saw cylinders. However, this solution is more costly and requires more space than normal solutions.

Figure 1:
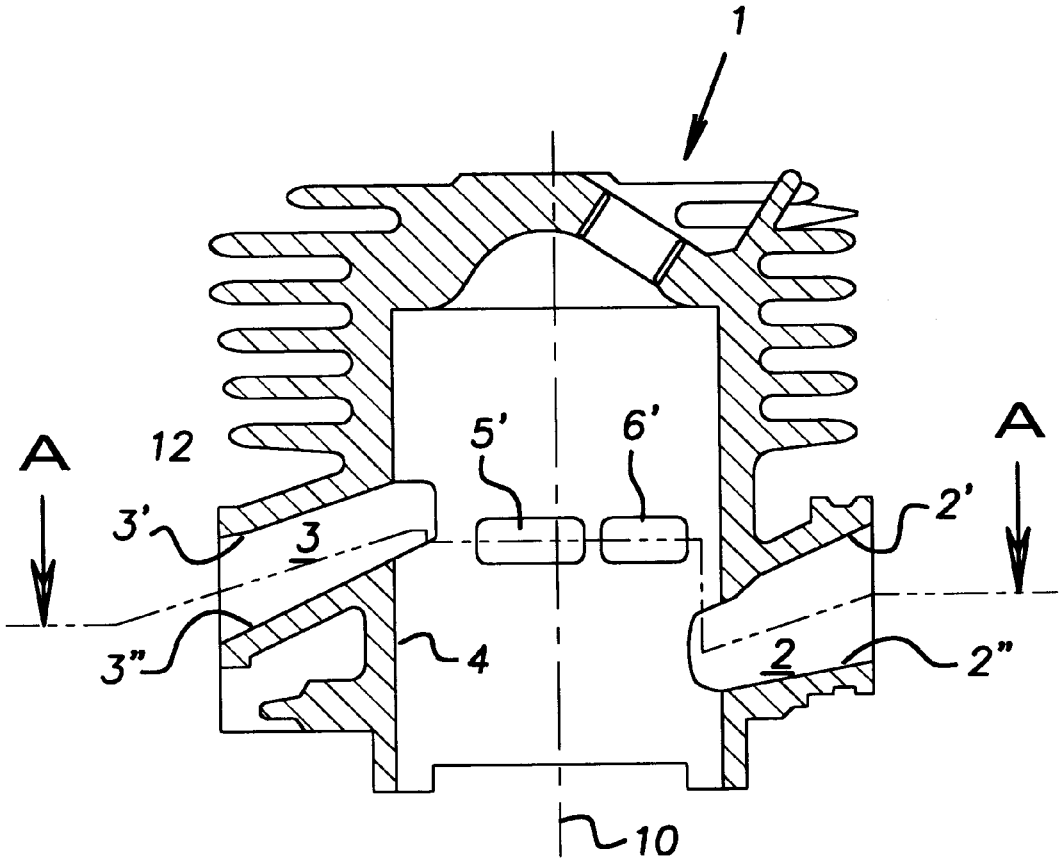
FIG. 1 shows a cross section of the cylinder seen from the side, in accordance with the subject invention.
Figure 2:
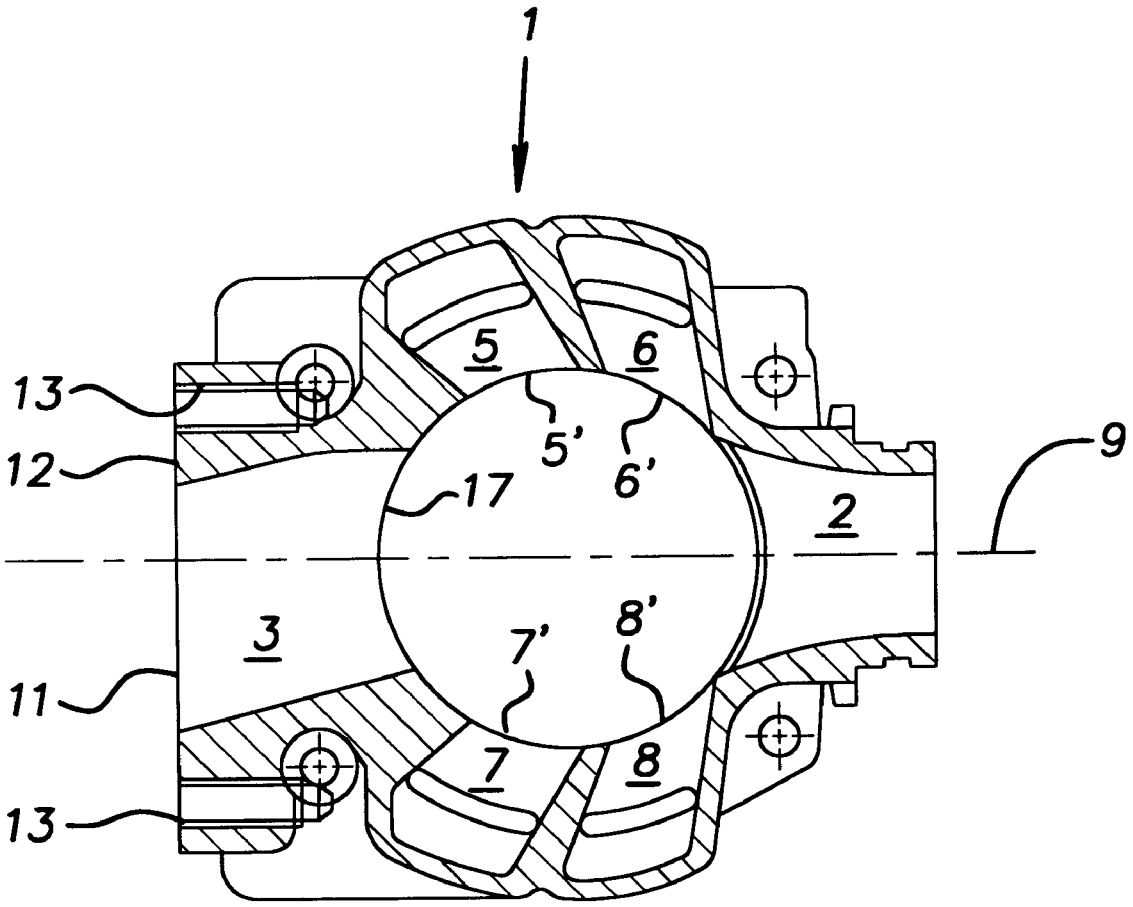
FIG. 2 shows a cross section of the cylinder in FIG. 1 along line A—A.

Thus FIG. 2 shows a cross section along line A—A. This line extends through the inlet port 2 and the exhaust port 3 as well as through the mouths 5', 6' 7' and 8' of the transfer ports. The exhaust port's 3 mouth 17 inside the cylinder as well as the cylinder's transfer ports 5, 6, 7 and 8 are arranged symmetrically around a common symmetry plane 9, which follows the cylinder's symmetry axis 10. This symmetry is essential in order to reduce the scavenging losses out into the exhaust port 3 during the transfer or the scavenging. At the mouth 11 of the exhaust port 3 on the outside of the cylinder a fastening plane 12 with fastening holes 13 is embodied for a directly mounted muffler. The fastening plane 12 is essentially perpendicular to the symmetry plane 9, and the exhaust port 3 is angled sideways in relation to the symmetry plane 9 and its mouth 11 is shifted sideways in relation to the symmetry plane 9. This angling and shifting has been carried out to make room for a desirable muffler. The demands for compact outer dimensions and low weight are as mentioned extremely stringent for a handheld working tool, such as a chain saw. The angling and the shifting do not imply an improved flow but possibly a very marginal deterioration. They are however necessary in order to make possible the other efficiency increasing measures. The inlet port 2 is also arranged symmetrically around the symmetry plane 9. Hereby it will be positioned on the opposite side of the cylinder body compared to the exhaust port 3. A fuel supply device, for instance a carburetor, is positioned in connection with the inlet port 2. This means that the fuel supply device is positioned on the opposite side of the directly mounted muffler. This results in a desirable division into a warm side with the muffler and a cool side with the fuel supply device. A cooling fan is usually located on the crankshaft on either side of the engine body. The crankshaft then essentially extends perpendicularly in relation to the symmetry plane 9.

As illustrated in FIG. 2, sections of the transfer ports 5–8 have been extended far out from the cylinder bore 4. This also becomes evident in comparison with FIG. 3, which shows that the lower part of the cylinder has quite a substantial width by the transfer ports. Hereby, relatively long guide sectiones can be used adjacent to the cylinder bore 4 . This gives a good control of the gas flow and reduces the losses of scavenging gas out into the exhaust port 3. Thus, in this way fuel consumption and the exhaust emissions are reduced.

Figure 3:
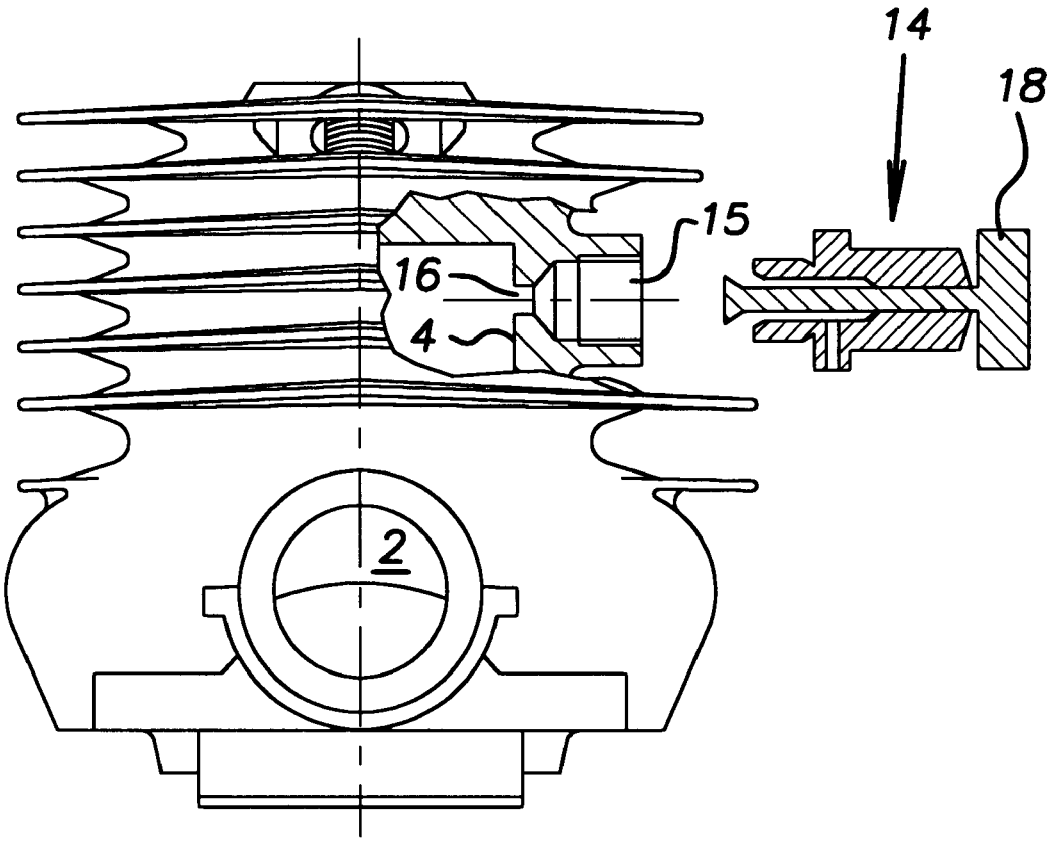
FIG. 3 shows the cylinder, in accordance with FIGS. 1 and 2, seen from the side, in the direction towards its inlet port. A partial cross section is made in order to illustrate a port intended for a decompression valve. For the sake of clarity, the valve is illustrated located outside the port in which it usually is mounted.

FIG. 3 shows how a port 15 is embodied in an essentially perpendicular direction in relation to the cylinder's axial direction and connecting with the cylinder bore's 4 upper part, so low that at least the engine's top piston ring passes the port's 15 mouth 16 in the cylinder bore 4. The decompression valve 14, which is intended to be mounted in port 15, is for the sake of clarity shown outside port 15. The port 15 is supplied with a threaded part into which the decompression valve 14 is wound. The valve 14 is shown in the open position. When starting, the valve is placed in this position by its maneuver part 18 being depressed. Hereby a leakage occurs, which makes a manual start of the engine less strenuous. When the engine starts the valve automatically closes by the cylinder pressure. However, even in the closed position a decompression valve usually has a minor leakage of a few percents. Thus, the usage of a decompression valve implies a deterioration, but can be a demand in many applications. The illustrated positioning of the decompression valve is very special and reduces the above mentioned loss. The gas leakage out through a closed decompression valve is at its maximum when the pressure is highest in the cylinder. This occurs at or close to the piston's top dead center. In this case, owing to the piston's top piston ring passing the port's 15 mouth 16, the above mentioned loss is reduced. Thus, this special positioning of the decompression valve 14 contributes to a high cylinder efficiency, as well as the design of the transfer ports and the inlet port and the exhaust port.

I claim:

1. Cylinder (1) for a two-stroke combustion engine intended for a handheld working tool, said cylinder having an exhaust port (3), a plurality of transfer ports (5, 6, 7, 8), and being symmetrical about a plane (9), an interior mouth (17) of the exhaust port (3), as well as the transfer ports (5, 6, 7, 8), are arranged symmetrically around said symmetry plane (9) which follows the cylinder's symmetry axis (10), and, at an exterior mouth (11) of the exhaust port (3), said cylinder defining a fastening plane (12) with fastening holes (13) for a directly mounted muffler, said fastening plane (12) being generally perpendicular to the symmetry plane (9), said exhaust port (3) being angled sideways relative to the symmetry plane (9) and said exterior exhaust port mouth (11) is shifted sideways relative to the symmetry plane (9).

2. Cylinder (1) in accordance with claim 1, wherein said cylinder further comprises an inlet port (2), said inlet port (2) and said exhaust port (3) incline downwards in a flow direction relative to a plane perpendicular to an axial direction of said cylinder bore.

3. Cylinder (1) in accordance with claim 2, wherein upper and lower sides of the inlet sort (2) and exhaust port (3) incline downwards in the flow direction relative to the plane which is perpendicular to the axial direction of said cylinder bore.

4. Cylinder (1) in accordance with claim 2, wherein the inlet port (2) is arranged symmetrically around the symmetry plane (9).

5. Cylinder (1) in accordance with claim 1, wherein the cylinder is supplied with four closed and ready cast transfer ports (5, 6, 7, 8).

6. Cylinder (1) in accordance with claim 1, wherein the cylinder is supplied with a decompression valve (14), a port (15) of said valve is designed in an essentially perpendicular direction relative to the cylinder's axial direction and connects with an upper part of the cylinder bore (4), so that at least the engine's top piston ring passes a mouth (16) of said valve port (15).

* * * * *